US010883158B2

(12) United States Patent
Park et al.

(10) Patent No.: US 10,883,158 B2
(45) Date of Patent: Jan. 5, 2021

(54) MAGNESIUM ALLOY MATERIALS AND METHOD FOR PRODUCING THE SAME

(71) Applicant: UNIST (ULSAN NATIONAL INSTITUTE OF SCIENCE AND TECHNOLOGY), Ulsan (KR)

(72) Inventors: Sung Soo Park, Ulsan (KR); Soo Min Baek, Ulsan (KR); Beom Cheol Kim, Ulsan (KR)

(73) Assignee: UNIST (ULSAN NATIONAL INSTITUTE OF SCIENCE AND TECHNOLOGY), Ulsan (KR)

( * ) Notice: Subject to any disclaimer, the term of this patent is extended or adjusted under 35 U.S.C. 154(b) by 0 days.

(21) Appl. No.: 15/750,899

(22) PCT Filed: Jun. 2, 2017

(86) PCT No.: PCT/KR2017/005802
§ 371 (c)(1),
(2) Date: Feb. 7, 2018

(87) PCT Pub. No.: WO2017/209566
PCT Pub. Date: Dec. 7, 2017

(65) Prior Publication Data

US 2019/0112692 A1 Apr. 18, 2019

(30) Foreign Application Priority Data

Jun. 2, 2016 (KR) ..... 10-2016-0068588
May 18, 2017 (KR) ..... 10-2017-0061764

(51) Int. Cl.

| | |
|---|---|
| ***C22C 23/02*** | (2006.01) |
| ***C22C 1/02*** | (2006.01) |
| ***C22C 23/04*** | (2006.01) |
| ***C22C 23/00*** | (2006.01) |
| ***B22D 21/00*** | (2006.01) |
| ***B22D 21/04*** | (2006.01) |

(52) U.S. Cl.
CPC ..... *C22C 23/02* (2013.01); *B22D 21/007* (2013.01); *B22D 21/04* (2013.01); *C22C 1/02* (2013.01); *C22C 23/00* (2013.01); *C22C 23/04* (2013.01)

(58) Field of Classification Search
CPC ..... C22C 23/02; C22C 23/04; C22F 1/06
See application file for complete search history.

(56) References Cited

FOREIGN PATENT DOCUMENTS

| | | |
|---|---|---|
| JP | 2006-002184 | 1/2006 |
| JP | 2006-070303 | 3/2006 |
| JP | 2009-501845 | 1/2009 |
| JP | 2013-514463 | 4/2013 |
| JP | 2013-524004 | 6/2013 |
| JP | 2014-205920 | 10/2014 |
| KR | 10-2004-0035646 | 4/2004 |
| KR | 10-2015-0076459 | 7/2015 |
| KR | 10-2015-0144593 | 12/2015 |
| KR | 10-2017-0049083 | 5/2017 |
| KR | 10-2017-0049084 | 5/2017 |

*Primary Examiner* — Jessee R Roe
(74) *Attorney, Agent, or Firm* — Lex IP Meister, PLLC

(57) ABSTRACT

The present invention relates to a magnesium alloy material and a method for manufacturing the same. The magnesium alloy material comprises, with respect to the total of 100 wt % thereof: Sc of 0.01 to 0.3 wt %; Al of 0.05 to 15.0 wt %; and the balance being Mg and other unavoidable impurities, wherein the magnesium alloy comprises a secondary phase compound comprising Al and Sc in the alloy in which a Volta potential difference between the secondary phase compound and a magnesium base is less than 920 mV.

11 Claims, 13 Drawing Sheets

MAGNESIUM ALLOY MATERIALS AND METHOD FOR PRODUCING THE SAME

TECHNICAL FIELD

An embodiment of the present invention provides a magnesium alloy material and a method of producing the same.

BACKGROUND ART

A magnesium alloy has the lowest specific gravity and excellent specific strength and specific rigidity among practically available structure materials and recently, has been increasingly demanded in automobiles and electronic products requiring lightness. In addition, since the magnesium alloy has been suggested as a medical biodegradable implant, research on developing a magnesium material for a surgical implant for a bone fraction and a stent for a blood vessel/a digestive organ is being actively made.

Conventional research had been focused on a magnesium alloy for an auto engine, a gear part, or the like based on excellent castability of magnesium, but research on a magnesium alloy for processibility into an extruded material or a sheet material more variously applicable to where lightness has recently been required is actively being made.

Most of magnesium alloys such as a magnesium-aluminum-based alloy, a magnesium-zinc-based alloy, a magnesium-tin-based alloy, and the like show a very high corrosion rate compared with competitive metal aluminum alloys, and this high corrosion rate plays a role of obstructing commercial availability of the magnesium alloys as structural and medical materials.

PRIOR ART

Patent Reference (Patent reference 1) Korean Patent Laid-Open Publication No. 2012-0095184

DISCLOSURE

Technical Problem

Accordingly, the present invention is to provide a novel magnesium alloy material having a low corrosion rate as well as excellent mechanical characteristics and thus increased commercial availability into various parts requiring lightness and a method of producing the same.

Technical Solution

An embodiment of the present invention provides a magnesium alloy material comprising, with respect to the total of 100 wt % thereof: Sc of 0.01 to 0.3 wt %; Al of 0.05 to 15.0 wt %; and the balance being Mg and other unavoidable impurities, wherein the magnesium alloy material comprises a secondary phase compound comprising Al and Sc in the alloy in which a Volta potential difference between the secondary phase compound and a magnesium base is less than 920 mV.

An amount of Al of the magnesium alloy material may be 0.05 to 9.0 wt % with respect to the total of 100 wt % of the magnesium alloy material.

The magnesium alloy material may further include at least one metal selected from Zn of 0.005 to 10.0 wt %, Mn of 0.005 to 2.0 wt %, or Ca of 0.005 to 2.0 wt % with respect to the total of 100 wt % of the magnesium alloy material.

More specifically, the magnesium alloy material may further include at least one metal selected from Zn of 0.5 to 5.0 wt %, Mn of 0.05 to 1.0 wt %, or Ca of 0.25 to 1.0 wt % with respect to the total of 100 wt % of the magnesium alloy material.

The secondary phase compound may have an average particle diameter of 0.1 to 10 μm, and more specifically 0.5 to 3 μm.

The Volta potential difference between the secondary phase compound and a magnesium base may be less than or equal to 750 mV.

The magnesium alloy material may exhibit a corrosion rate of less than or equal to 1.22 mmpy, and more specifically greater than 0 mmpy and less than or equal to 1.22 mmpy in a room temperature immersion test in a 3.5 wt % of NaCl solution for 72 hours.

A magnesium alloy material according to an embodiment of the present invention comprises, with respect to the total of 100 wt % thereof: Al of 0.5 to 12 wt %, Ca of 0.05 to 2 wt %, Y of 0.005 to 0.5 wt %, Sc of 0.02 to 0.6 wt %, the balance being Mg and other unavoidable impurities.

A sum of the weights of the Ca, Y, and Sc components may be greater than or equal to 0.3 wt %.

The magnesium alloy material may further include Mn of less than or equal to 0.5 wt % with respect to the total of 100 wt % of the magnesium alloy material.

The magnesium alloy material may further include Zn of less than 5 wt % with respect to the total of 100 wt % of the magnesium alloy material. More specifically, it may further include Zn of 0.1 to 4.5 wt %.

The magnesium alloy material may exhibit a corrosion rate of less than or equal to 1.0 mmpy in a room temperature immersion test in a 3.5 wt % of NaCl solution for 72 hours.

The magnesium alloy material may have an ignition temperature of greater than or equal to 700° C.

Another embodiment of the present invention provides a method of producing a magnesium alloy material comprises preparing a melt solution of a magnesium alloy including Sc of 0.01 to 0.3 wt %; Al of 0.05 to 15.0 wt %; and the balance being Mg and other unavoidable impurities with respect to the total of 100 wt % of the melt solution of the magnesium alloy material; and casting the melt solution of the magnesium alloy while maintaining it at 650 to 800° C.; wherein the produced magnesium alloy material comprises a secondary phase compound comprising Al and Sc in the alloy, in which a Volta potential difference between the secondary phase compound and a magnesium base is less than 920 mV.

An amount of Al in the melt solution of the magnesium alloy may be 0.05 to 9.0 wt % with respect to the total of 100 wt % of the melt solution of the magnesium alloy.

The melt solution of the magnesium alloy may further comprise, with respect to the total of 100 wt % of the melt solution of the magnesium alloy, at least one metal selected from Zn of 0.005 to 10.0 wt %, Mn of 0.005 to 2.0 wt %, or Ca of 0.005 to 2.0 wt % and more specifically, the melt solution of the magnesium alloy may further comprise, with respect to the total of 100 wt % of the melt solution of the magnesium alloy, at least one metal selected from Zn of 0.5 to 5.0 wt %, Mn of 0.05 to 1.0 wt %, or Ca of 0.25 to 1.0 wt %. The casting may be performed by sand casting, gravity pressure casting, press casting, strip casting, continuous casting, die casting, precision casting, spray casting, semi-solidification casting, quenching casting, indirect extrusion, hydrostatic extrusion, continuous extrusion, direct/indirect extrusion, impact extrusion, equal channel angular pressing, side-extrusion casting, uniform speed rolling, differential speed rolling, Caliber rolling, ring rolling, free forging, die forging, hammer forging, press forging, upset forging, roll forging, or a combination thereof.

A method of producing a magnesium alloy material according to another embodiment of the present invention comprises preparing a melt solution Al of 0.5 to 12 wt %, Ca of 0.05 to 2 wt %, Y of 0.005 to 0.5 wt %, Sc of 0.02 to 0.6 wt %, the balance being Mg and other unavoidable impurities with respect to the total of 100 wt %; and casting the melt solution to produce a cast material; wherein a sum of the weights of the Ca, Y, and Sc components of the melt solution is greater than or equal to 0.3 wt %.

The melt solution may further include Mn of less than or equal to 0.5 wt % with respect to the total of 100 wt %.

The melt solution may further include Zn of less than 5 wt % with respect to the total of 100 wt %. More specifically, it may further include Zn of 0.1 to 4.5 wt %.

The casting the melt solution to produce a cast material may be performed at a temperature range of 650° C. to 800° C.

Advantageous Effects

According to an embodiment of the present invention, provided is a magnesium alloy material having improved anti-corrosion by solving galvanic corrosion problem due to unavoidable impurities therein. This magnesium alloy material may be variously used as an extruded material, a sheet material, a forging material, a cast material, and the like practically applicable to an industry requiring an excellent anti-corrosion and the like.

In addition, one embodiment of the present invention may provide a magnesium alloy sheet material simultaneously having excellent anti-corrosion and anti-ignition.

DESCRIPTION OF THE DRAWINGS

FIG. 12 shows compression cracks of Comparative Example 6a.

MODE FOR INVENTION

Figure 1:
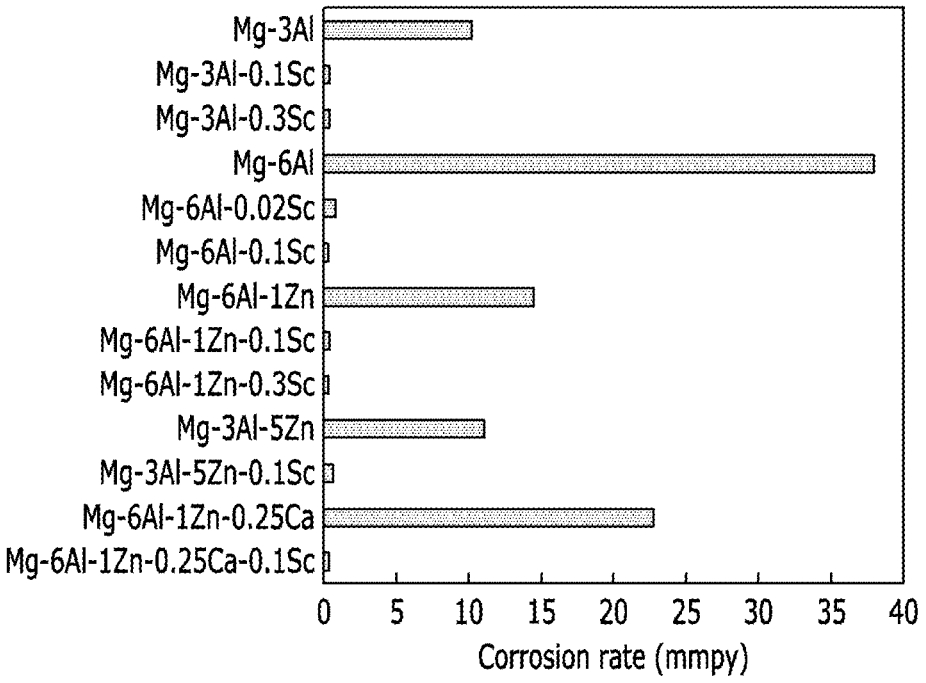
FIG. 1 is a graph showing corrosion rates of magnesium alloys according to Comparative Examples 1, 2, 3, 4, 5, 6, and 8 and Examples 11, 12, 13, and 24 of the present invention.

Hereinafter, embodiments of the present invention are described in detail. However, these embodiments are exemplary, the present invention is not limited thereto and the present invention is defined by the scope of claims.

Unless otherwise defined, all terms (including technical and scientific terms) used herein have the same meaning as commonly understood by one of ordinary skill in the art. In addition, throughout the specification, unless explicitly described to the contrary, the word "comprise" and variations such as "comprises" or "comprising," will be understood to imply the inclusion of stated elements but not the exclusion of any other elements. Further, the singular forms are intended to include the plural forms as well, unless the context clearly indicates otherwise.

In the present specification, an "average particle diameter" indicates an average diameter of a spherical shape material within a measurement unit unless a specific definition is provided. When a material has a non-spherical shape, the "average particle diameter" indicates a spherical diameter obtained by approximating the non-spherical shape into a spherical shape.

An embodiment of the present invention provides a magnesium alloy material comprises, with respect to the total of 100 wt % of the magnesium alloy material, Sc of 0.01 to 0.3 wt %; Al of 0.05 to 15.0 wt %; and the balance being Mg and other unavoidable impurities, wherein the magnesium alloy material comprises a secondary phase compound comprising Al and Sc in the alloy in which a Volta potential difference between the secondary phase compound and a magnesium base is less than 920 mV.

The present inventors have made an effort to solve the galvanic corrosion problem of the magnesium alloy material due to inevitable impurities and thus found out to provide a magnesium alloy having much improved anti-corrosion by adding a small amount of scandium (Sc) along with aluminum (Al) to the magnesium alloy.

Compared with aluminum, magnesium has the weakest problem of anti-corrosion mainly due to the low reduction potential. As for a magnesium alloy material, the added alloy elements may be bonded with unavoidable impurity elements such as iron, nickel, copper, cobalt, and the like and produce a secondary phase compound such as an intermetallic compound, and when the secondary phase compound has a higher reduction potential than the magnesium base, magnesium may be corroded by microgalvanic corrosion due to a reduction potential difference between the magnesium base and the secondary phase compound, and the larger the reduction potential difference is, the more the magnesium corrosion is promoted. The reduction potential difference between the magnesium base and the secondary phase compound may be estimated by measuring an open circuit potential (OCP) in each experimentally particular solution and then, comparing the measurements or comparing Volta potentials of the magnesium base and the secondary phase compound through Scanning Kelvin Probe Force Microscopy.

The magnesium corrosion due to the microgalvanic corrosion may be suppressed by adjusting a Volta potential difference between the secondary phase compound and the magnesium base in the alloy into less than 920 mV, magnesium base.

The secondary phase compound mainly consists of Al and Sc and includes impurities such as Si and Fe. Since the secondary phase compound including Sc having a similar reduction potential to that of magnesium is formed, the Volta potential difference between the secondary phase compound and the magnesium base is reduced, and accordingly, the magnesium corrosion due to the microgalvanic corrosion may be suppressed.

Specifically, the Volta potential difference between the secondary phase compound and the magnesium base in the alloy may be in a range of greater than 0 mV and less than 920 mV; or greater than or equal to 550 mV and less than 920 mV. More specifically, the Volta potential difference may be in a range of greater than or equal to 550 mV and less than or equal to 750 mV.

An average particle diameter of the secondary phase compound may be 0.1 to 10 μm. More specifically, it may be 0.5 to 3.0 μm. When the secondary phase compound has too small an average particle diameter, microgalvanic corrosion rate is deteriorated, and thus the secondary phase compound may limitedly have an influence on the magnesium corrosion. When the secondary phase compound has too large an average particle diameter, mechanical characteristics and particularly, ductility of the alloy may be deteriorated.

An amount of Al of the magnesium alloy material may be 0.05 to 15.0 wt % with respect to the total of 100 wt % of the magnesium alloy material.

More specifically, with respect to the total of 100 wt % of the magnesium alloy material, it may be 0.05 to 9.0 wt %; greater than or equal to 0.05 wt % and less than 9.0 wt %; 0.05 to 6.0 wt %; 0.05 to 5.5 wt %; 1.0 to 3.0 wt %; 1.0 to 6.0 wt %; 1.0 to 9.0 wt %; 3.0 to 9.0 wt %; 6.0 to 9.0 wt %; or 0.3 to 9.0wt %.

Aluminum included in the magnesium alloy material is bonded with scandium and contributes to improving anti-corrosion and in addition, plays a role of increasing strength of an alloy through precipitation reinforcement effect and contributing to increasing strength of the alloy through solid-dissolution reinforcement. When an amount of aluminum is too small, anti-corrosion improvement and strength increase effects may not be expected. When the amount of aluminum is too large, corrosion may be promoted due to an excessive fraction of particles including aluminum.

An amount of Sc in the magnesium alloy may be 0.01 to 0.3 wt % with respect to the total of 100 wt % of the magnesium alloy material.

When an amount of scandium is too small, an effect of adding scandium for improving anti-corrosion may not be expected due to a small fraction of secondary particles including scandium. When an amount of scandium is too large, galvanic corrosion may be promoted due to an excessive fraction of the particles including scandium.

The amount of the scandium may be specifically 0.1 to 0.3 wt %.

The magnesium alloy material may further include at least one metal selected from Zn of 0.005 to 10.0 wt %, Mn of 0.005 to 2.0 wt %, or Ca of 0.005 to 2.0 wt % with respect to the total of 100 wt % of the magnesium alloy material.

More specifically, the magnesium alloy material may further include at least one metal selected from Zn of 0.5 to 5.0 wt %, Mn of 0.05 to 1.0 wt %, or Ca of 0.25 to 1.0 wt % with respect to the total of 100 wt % of the magnesium alloy material. Zinc included in the magnesium alloy material like aluminum plays a role of increasing precipitation reinforcement effect and contributing to a strength increase of the alloy through solid-dissolution reinforcement, but when an amount of zinc is too small, the strength increase effect may not be expected, and thus, the magnesium alloy material may not be used as a structural material. When the amount of zinc is too small, a fraction of particles including zinc is excessive, and thus galvanic corrosion may be promoted.

Manganese included in the magnesium alloy material may contribute to forming a compound including manganese and impurities in a magnesium alloy and improving anti-corrosion of the alloy as well as increasing strength of the alloy through solid-dissolution reinforcement and the like. When manganese is included in too small an amount, the strength increase and anti-corrosion improvement effects may be insufficient. When manganese is included in too large an amount, a galvanic corrode may be promoted due to an excessive fraction of particles including manganese.

Calcium included in the magnesium alloy material plays a role of increasing strength of an alloy through solid-dissolution reinforcement as well as precipitation reinforcement. When an amount of calcium is too small, the precipitation reinforcement effect may be insufficient. When the amount of calcium is too large, galvanic corrosion may be promoted due to an excessive fraction of particles including calcium.

The magnesium alloy material may include raw materials of an alloy or impurities such as iron (Fe), silicon (Si), nickel (Ni), copper (Cu), and cobalt (Co) inevitably mingled therewith during the manufacturing process. These impurities may cause deterioration of anti-corrosion of the magnesium alloy. Accordingly, an amount of iron (Fe) may be less than or equal to 0.004 wt %, an amount of silicon (Si) may be less than or equal to 0.01 wt %, an amount of copper (Cu) may be less than or equal to 0.005 wt %, an amount of nickel (Ni) may be less than or equal to 0.001 wt, and an amount of cobalt (Co) may be less than or equal to 0.001 wt %.

In addition, the magnesium alloy material may have a corrosion rate of less than or equal to 1.22 mmpy and specifically, greater than 0 mmpy and less than or equal to 1.22 mmpy through an immersion experiment in a 3.5 wt % NaCl solution for 72 hours. Accordingly, anti-corrosion not obtainable from a conventional magnesium alloy may be realized due to this performance of a magnesium alloy material according to the present invention.

Another embodiment of the present invention provides a magnesium alloy material including Al of 0.5 to 12 wt %, Ca of 0.05 to 2 wt %, Y of 0.005 to 0.5 wt %, Sc of 0.02 to 0.6 wt %, the balance being Mg and other unavoidable impurities with respect to the total of 100 wt % of the magnesium alloy.

More specifically, an embodiment of the present invention provides a magnesium alloy material including Al, Ca, Y, and Sc essentially.

Herein, a sum of the weights of the Ca, Y, and Sc components may be 0.3 wt %. Specifically, an effect of increasing an anti-ignition temperature of an alloy may be expected by controlling a sum of weights of calcium, yttrium, and scandium.

More specifically, a reason of limiting a component and a composition of the magnesium alloy material is as follows.

First, aluminum plays a role of contributing strength through solid-dissolution reinforcement and precipitation reinforcement and improving stability of an oxide film during the corrosion and thus improving anti-corrosion.

Accordingly, when an amount of aluminum is too small, an effect of increasing strength and improving anti-corrosion may not be expected. On the other hand, when an amount of aluminum is too large, microgalvanic corrosion may be caused by an excessive faction of particles including aluminum.

Calcium plays a role of increasing an ignition temperature of magnesium.

Accordingly, when an amount of calcium is too small, the effect of increasing an anti-ignition temperature may be insufficient. On the other hand, when the amount of calcium is too large, stresses may be focused around particles during the hot machinery process due to an excessive fraction of particles including calcium and thus cause a crack.

Yttrium in general plays a role of improving an anti-ignition and thus increasing an ignition temperature of a magnesium alloy material.

Accordingly, when yttrium is added in too small an amount, an effect of improving anti-ignition may be insufficient due to a low ignition temperature. On the other hand, when yttrium is added too large an amount, there may be a problem of promoting microgalvanic corrosion and increasing an alloy cost due to an excessive fraction of particles including yttrium.

Scandium plays a role of improving anti-corrosion of a magnesium alloy material.

Accordingly, when an amount of scandium is too small, an effect of adding scandium to improve anti-corrosion may not be expected due to a small fraction of secondary particles including scandium. On the other hand, when the amount of scandium is too large, there may be a problem of promoting microgalvanic corrosion and increasing an alloy cost due to an excessive fraction of particles including scandium.

Manganese contributes to increasing strength of an alloy through solid-dissolution reinforcement and the like. In addition, a compound including manganese and impurities is formed in a magnesium alloy and thus improves anti-corrosion of the alloy.

Accordingly, when an amount of manganese is too small, an effect of increasing strength and improving anti-corrosion may be insufficient. In a magnesium alloy material including scandium, an effect of increasing anti-corrosion may be obtained. However, in the magnesium alloy material including scandium, when manganese is included in too large an amount, the anti-corrosion effect may be deteriorated due to an effect of promoting microgalvanic corrosion between particles including manganese and magnesium. Accordingly, an upper limit of manganese may be limited according to one embodiment of the present invention.

Accordingly, manganese may be included in an amount of less than or equal to 0.5 wt % based on 100 wt % of a total weight of the magnesium alloy material. Specifically, Mn may be included in an amount of 0.1 to 0.5 wt %.

Like aluminum, zinc plays a role of contributing to increasing strength of the ally through solid-dissolution reinforcement and precipitation reinforcement.

Accordingly, when zinc is included in too small amount, the strength effect may not be expected, and thus the alloy may not be used as a structural material. On the contrary, when zinc is included in too large an amount, microgalvanic corrosion may be promoted due to an excessive fraction of particles including zinc. In addition, stability of an oxide film is deteriorated, and thus anti-corrosion may be deteriorated. Accordingly, an upper limit of zinc may be limited according to one embodiment of the present invention.

Accordingly, Zn may be included in an amount of less than 5 wt % based on 100 wt % of the magnesium alloy material. Specifically, the amount of Zn may be less than or equal to 4.5 wt %. More specifically, the amount of Zn may be in a range of 0.1 to 4.5 wt %.

The magnesium alloy material satisfying the component and the composition may exhibit a corrosion rate of less than or equal to 1.0 mmpy in a room temperature immersion test in a 3.5 wt % of NaCl solution for 72 hours.

More specifically, the corrosion rate may be less than or equal to 0.95 mmpy.

As described above, a magnesium alloy material having excellent anti corrosion may be provided by limiting a composition range of components.

The magnesium alloy may have an ignition temperature of greater than or equal to 700° C.

The higher the ignition temperature of the magnesium alloy, the better, and thus the upper limit is not limited.

As described above, when calcium and yttrium are included within the ranges of one embodiment of the present invention, a magnesium alloy material having excellent anti-ignition may be provided.

Another embodiment of the present invention provides a method of producing a magnesium alloy includes preparing a melt solution of a magnesium alloy including Sc of 0.01 to 0.3 wt %; Al of 0.05 to 15.0 wt %; and the balance being Mg and other unavoidable impurities with respect to the total of 100 wt % of the melt solution of the magnesium alloy material; and casting the melt solution of the magnesium alloy while maintaining it at 650 to 800° C.; wherein the produced magnesium alloy material comprises a secondary phase compound comprising Al and Sc in the alloy, in which a Volta potential difference between the secondary phase compound and a magnesium base is less than 920 mV.

An amount of Al in the melt solution may be 0.05 to 9.0 wt % with respect to the total of 100 wt % of the melt solution of the magnesium alloy. More specifically, with respect to the total of 100 wt % of the melt solution of the magnesium alloy material, it may be 0.05 to 9.0 wt %; 0.05 to 9.0 wt %; 0.05 to 6.0 wt %; 0.05 to 5.5 wt %; 1.0 to 3.0 wt %; 1.0 to 6.0 wt %; 1.0 to 9.0 wt %; 3.0 to 9.0 wt %; 6.0 to 9.0 wt %; or 0.3 to 9.0 wt %.

Aluminum included in a magnesium alloy material is bonded with scandium and thus contributes to improving anti-corrosion and in addition, plays a role of contributing to increasing precipitation reinforcement effect and an alloy strength through solid-dissolution reinforcement. When aluminum is included in too small an amount, an effect of improving anti-corrosion and increasing strength may not be expected. When the amount of aluminum is too large, galvanic corrosion may be promoted due to an excessive fraction of particles including aluminum.

An amount of Sc in the melt solution of the magnesium alloy material may be 0.01 to 0.3 wt % with respect to the total of 100 wt % of the melt solution of the magnesium alloy material. More specifically, it may be 0.1 to 0.3 wt %. When scandium is included in too small an amount, an effect of adding scandium for improving anti-corrosion may not be expected due to a small fraction of secondary particles including scandium. When the amount of scandium is too large, galvanic corrosion may be promoted due to an excessive fraction of particles including scandium.

The melt solution may further include at least one metal selected from Zn of 0.005 to 10.0 wt %; Mn of 0.005 to 2.0 wt %; or Ca of 0.005 to 2.0 wt % with respect to the total of 100 wt % of the melt solution of the magnesium alloy material.

More specifically, it may further include at least one metal selected from Zn of 0.5 to 5.0 wt %; Mn of 0.05 to 1.0 wt %; or Ca of 0.25 to 1.0 wt % with respect to the total of 100 wt % of the melt solution of the magnesium alloy material.

Like aluminum, zinc included in the magnesium alloy material may increase precipitation reinforcement effect and contribute to increasing strength of an ally through solid-dissolution reinforcement, and when an amount of zinc is too small, a strength increase effect may not be expected, and thus the alloy may not be used as a structural material. When zinc is added in too large an amount, a galvanic corrode may be promoted due to an excessive fraction of particles including zinc.

Manganese includes in magnesium alloy material may play a role of forming a compound including manganese and impurities in the alloy and thus improving anti-corrosion of the magnesium alloy as well as contributing to increasing strength of an alloy. When an amount of manganese is too small, an effect of increasing strength and improving anti-corrosion may be insufficient. When the amount of manganese is too large, galvanic corrosion may be caused due to an excessive fraction of particles including manganese.

Calcium included in a magnesium alloy material plays a role of contributing to increasing strength of an alloy through solid-dissolution reinforcement as well as precipitation reinforcement. When an amount of calcium is too small, the precipitation reinforcement effect may be insufficient. When the amount of calcium is too large, galvanic corrosion may be promoted due to an excessive fraction of particles including calcium.

The casting may be performed by sand casting, gravity pressure casting, press casting, strip casting, continuous casting, die casting, precision casting, spray casting, semi-solidification casting, quenching casting, indirect extrusion, hydrostatic extrusion, continuous extrusion, direct/indirect extrusion, impact extrusion, equal channel angular pressing, side-extrusion casting, uniform speed rolling, differential speed rolling, Caliber rolling, ring rolling, free forging, die forging, hammer forging, press forging, upset forging, roll forging, or a combination thereof, but is not limited thereto.

A method of producing a magnesium alloy material according to yet another embodiment of the present invention includes preparing a melt solution including Al of 0.5 to 12 wt %, Ca of 0.05 to 2 wt %, Y of 0.005 to 0.5 wt %, Sc of 0.02 to 0.6 wt %, the balance being Mg and other unavoidable impurities with respect to the total of 100 wt %; and casting the melt solution to produce a cast material.

Herein, a sum of the weights of the Ca, Y, and Sc components may be greater than or equal to 0.3 wt %.

The melt solution may further include Mn of less than or equal to 0.5 wt % with respect to the total of 100 wt %. Specifically, it may further include Mn of 0.1 to 0.5 wt %.

The melt solution may further include Zn of less than 5 wt % with respect to the total of 100 wt %. Specifically, it may further include Zn of 0.1 to 4.5 wt %.

A reason of limiting a component and composition of the melt solution is the same as limiting a component and a composition of the magnesium alloy material.

The casting the melt solution to produce a cast material may be performed at a temperature range of 650 to 800° C.

More specifically, the cast material may be produced by sand casting, gravity pressure casting, press casting, low pressure casting, lost wax casting, strip casting, strip casting, single roll casting, continuous casting, electromagnetic casting, electromagnetic continuous casting, die casting, precision casting, freeze-casting, spray casting, centrifugal casting, semi-solidification casting, quenching casting, side-extrusion casting, single belt casting, twin belt casting, shell mold casting, moldless casting, 3D printing, or a combination thereof. However, it is not limited thereto.

The produced cast material may be heat-treated through a post process to improve mechanical characteristics.

The following examples illustrate the present invention in more detail. However, the following examples show exemplary embodiments of the present invention, but do not limit it.

EXAMPLE AND COMPARATIVE EXAMPLE

Production of Magnesium Alloy Material

Pure Mg (99.9%), pure Al (99.9%), pure Zn (99.9%), pure Mn (99.9%), and pure Ca (99.9%) were used. Mg alloys was respectively dissolved to have each composition in Table 1 in a graphite crucible by using a high frequency melting furnace.

Herein, in order to prevent oxidation of the obtained melt solutions, a $SF_6$ and $CO_2$ mixed gas was coated on the melt solutions to block the air from contacting the melts. After the melting, the melt solutions were respectively maintained at 750° C. for 10 minutes and manufactured into 80 mm-high, 40 mm-wide, and 12 mm-thick as-cast specimens by using a steel mold preheated at 200° C.

TABLE 1

| | Alloy | Component (wt %) | | | | | |
|---|---|---|---|---|---|---|---|
| | | Al | Sc | Zn | Mn | Ca | Mg |
| 1 Comparative Example 1 | Mg—3Al | 3.0 | — | — | — | — | bal. |
| 2 Comparative Example 2 | Mg—6Al | 6.0 | — | — | — | — | bal. |
| 3 Comparative Example 3 | Mg—6Al—1Zn | 6.0 | — | 1.0 | — | — | bal. |
| 4 Comparative Example 4 | Mg—3Al—5Zn | 3.0 | — | 5.0 | — | — | bal. |
| 5 Comparative Example 5 | Mg—6Al—1Zn—0.25Ca | 6.0 | — | 1.0 | — | 0.25 | bal. |
| 6 Example 1 | Mg—1Al—0.1Sc | 1.0 | 0.1 | — | — | — | bal. |
| 7 Example 2 | Mg—3Al—0.01Sc | 3.0 | 0.01 | — | — | — | bal. |
| 8 Example 3 | Mg—3Al—0.02Sc | 3.0 | 0.02 | — | — | — | bal. |
| 9 Example 4 | Mg—3Al—0.05Sc | 3.0 | 0.05 | — | — | — | bal. |
| 10 Example 5 | Mg—3Al—0.1Sc | 3.0 | 0.1 | — | — | — | bal. |
| 11 Example 6 | Mg—3Al—0.3Sc | 3.0 | 0.3 | — | — | — | bal. |
| 12 Example 7 | Mg—6Al—0.02Sc | 6.0 | 0.02 | — | — | — | bal. |
| 13 Example 8 | Mg—6Al—0.1Sc | 6.0 | 0.1 | — | — | — | bal. |
| 14 Example 9 | Mg—1Al—1Zn—0.1Sc | 1.0 | 0.1 | 1.0 | — | — | bal. |
| 15 Example 10 | Mg—3Al—1Zn—0.1Sc | 3.0 | 0.1 | 1.0 | — | — | bal. |
| 16 Example 11 | Mg—6Al—1Zn—0.1Sc | 6.0 | 0.1 | 1.0 | — | — | bal. |

TABLE 1-continued

| | Alloy | Component (wt %) | | | | | |
|---|---|---|---|---|---|---|---|
| | | Al | Sc | Zn | Mn | Ca | Mg |
| 17 Example 12 | Mg—6Al—1Zn—0.3Sc | 6.0 | 0.3 | 1.0 | — | — | bal. |
| 18 Example 13 | Mg—3Al—5Zn—0.1Sc | 3.0 | 0.1 | 5.0 | — | — | bal. |
| 19 Example 14 | Mg—1Al—1Zn—0.3Mn—0.1Sc | 1.0 | 0.1 | 1.0 | 0.3 | — | bal. |
| 20 Example 15 | Mg—3Al—1Zn—0.05Mn—0.1Sc | 3.0 | 0.1 | 1.0 | 0.05 | — | bal. |
| 21 Example 16 | Mg—3Al—1Zn—0.1Mn—0.1Sc | 3.0 | 0.1 | 1.0 | 0.1 | — | bal. |
| 22 Example17 | Mg—3Al—1Zn—0.3Mn—0.1Sc | 3.0 | 0.1 | 1.0 | 0.3 | — | bal. |
| 23 Example 18 | Mg—3Al—1Zn—1.0Mn—0.1Sc | 3.0 | 0.1 | 1.0 | 1.0 | — | bal. |
| 24 Example 19 | Mg—6Al—1Zn—0.3Mn—0.1Sc | 6.0 | 0.1 | 1.0 | 0.3 | — | bal. |
| 25 Example 20 | Mg—9Al—1Zn—0.3Mn—0.1Sc | 9.0 | 0.1 | 1.0 | 0.3 | — | bal. |
| 26 Example 21 | Mg—0.3Al—0.5Ca—0.1Sc | 0.3 | 0.1 | — | — | 0.5 | bal. |
| 27 Example 22 | Mg—0.3Al—0.5Ca—0.3Sc | 0.3 | 0.3 | — | — | 0.5 | bal. |
| 28 Example 23 | Mg—0.3Al—0.5Zn—0.5Ca—0.3Sc | 0.3 | 0.3 | 0.5 | — | 0.5 | bal. |
| 29 Example 24 | Mg—6Al—1Zn—0.25Ca—0.1Sc | 6.0 | 0.1 | 1.0 | — | 0.25 | bal. |
| 30 Example 25 | Mg—6Al—1Zn—0.3Mn—0.25Ca—0.1Sc | 6.0 | 0.1 | 1.0 | 0.3 | 0.25 | bal. |
| 31 Example 26 | Mg—6Al—1Zn—0.3Mn—1.0Ca—0.1Sc | 6.0 | 0.1 | 1.0 | 0.3 | 1.0 | bal. |

EXPERIMENTAL EXAMPLE

Experimental Example 1

Evaluation of Corrosion Rate

Corrosion characteristics of total 31 magnesium alloy specimens according to Table 1 in sea water were evaluated through an immersion experiment of dipping the magnesium alloy specimens in a 3.5 wt % NaCl solution at 25° C. after respectively polishing the surface of the magnesium alloy specimens by a sandpaper level P1200. In other words, the magnesium alloy specimens were dipped in a 3.5 wt % NaCl solution at room temperature for 72 hours, a surface oxide layer formed during the immersion is removed by using a chromic acid ($CrO_3$) solution having a concentration of 200 g/L, and a weight change before and after the immersion was measured and used to calculate a corrosion rate (mmpy) of the specimens according to Equation 1, and the results are shown in Table 2.

$$\text{mm/year (mmpy)} = 87600 \times \text{decreased weight (g)} / \text{density (g/cm}^3\text{) of specimen} \times \text{immersion time (hr)} \times \text{exposed area (cm}^2\text{)} \quad \text{[Equation 1]}$$

TABLE 2

| | | Corrosion rate (mmpy) |
|---|---|---|
| 1 | Comparative Example 1 | 10.19 |
| 2 | Comparative Example 2 | 37.91 |
| 3 | Comparative Example 3 | 14.43 |
| 4 | Comparative Example 4 | 11.07 |
| 5 | Comparative Example 5 | 22.72 |
| 6 | Example 1 | 0.45 |
| 7 | Example 2 | 0.54 |
| 8 | Example 3 | 0.38 |
| 9 | Example 4 | 0.34 |
| 10 | Example 5 | 0.37 |
| 11 | Example 6 | 0.30 |
| 12 | Example 7 | 0.74 |
| 13 | Example 8 | 0.26 |
| 14 | Example 9 | 0.73 |
| 15 | Example 10 | 0.36 |
| 16 | Example 11 | 0.32 |
| 17 | Example 12 | 0.26 |
| 18 | Example 13 | 0.67 |
| 19 | Example 14 | 1.19 |
| 20 | Example 15 | 0.49 |
| 21 | Example 16 | 0.69 |
| 22 | Example17 | 1.04 |
| 23 | Example 18 | 1.22 |

TABLE 2-continued

| | | Corrosion rate (mmpy) |
|---|---|---|
| 24 | Example 19 | 0.68 |
| 25 | Example 20 | 0.30 |
| 26 | Example 21 | 0.90 |
| 27 | Example 22 | 0.36 |
| 28 | Example 23 | 0.31 |
| 29 | Example 24 | 0.26 |
| 30 | Example 25 | 0.61 |
| 31 | Example 26 | 0.65 |

Along with Table 2, FIG. 1 shows a corrosion rate of each magnesium alloy of Comparative Examples 1, 2, 3, 4, and 5 and Examples 5, 6, 7, 8, 11, 12, 13, and 24 of the present invention. As shown in data of Comparative Example 1 and Examples 5 and 6, the Mg-3Al alloy of Comparative Example 1 showed a decreased corrosion rate of less than or equal to 1/27 by adding 0.1 wt % or 0.3 wt % of Sc like those of Examples 5 or 6.

As for the Mg-6Al alloy of Comparative Example 2, a corrosion rate was decreased down to less than or equal to 1/51 by adding 0.02 wt % or 0.1 wt % of Sc like those of Examples 7 or 8.

As for the Mg-6Al-1Zn alloy of Comparative Example 3, a corrosion rate was decreased down to less than or equal to 1/45 by adding 0.1 wt % or 0.3 wt % of Sc like those of Examples 11 or 12.

As for the Mg-3Al-5Zn alloy of Comparative Example 4, a corrosion rate was decreased down to less than or equal to 1/16 by adding 0.1 wt % of Sc like that of Example 13.

As for the Mg-6Al-1Zn-0.25Ca alloy of Comparative Example 5, a corrosion rate was decreased down to less than or equal to 1/87 by adding 0.1 wt % of Sc like that of Example 24.

Experimental Example 2

Examination of Microstructure of Alloy

A microstructure of the alloys according to Comparative Example 1 and Examples 5 and 6 was examined by with scanning electron microscope (SEM). The results are shown in FIGS. 2 to 4.

Figure 2:
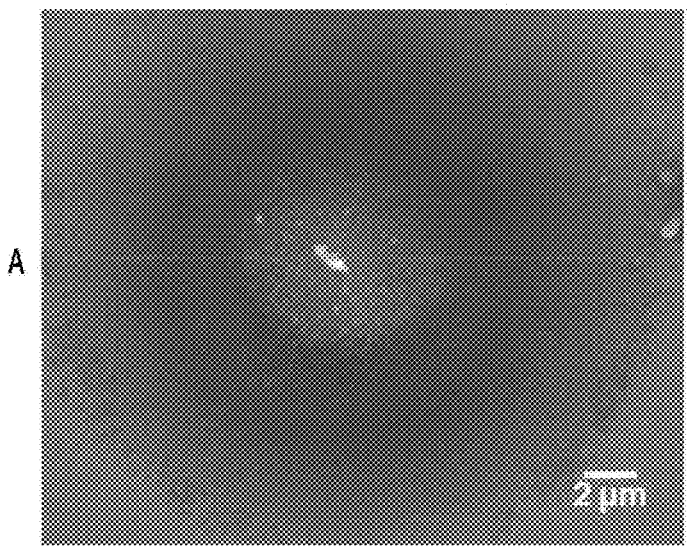
FIG. 2 is a scanning electron microscope (SEM) photograph showing a microstructure of the Mg-3Al alloy according to Comparative Example 1 of the present invention.

FIG. 2 shows a microstructure of Comparative Example 1 (Mg-3Al alloy), in which a secondary phase compound separated from magnesium in the alloy is present. Specifically, FIG. 2 confirms the presence of the secondary phase compound, and the secondary phase compound has an average particle diameter of about 1 μm.

Figure 3:
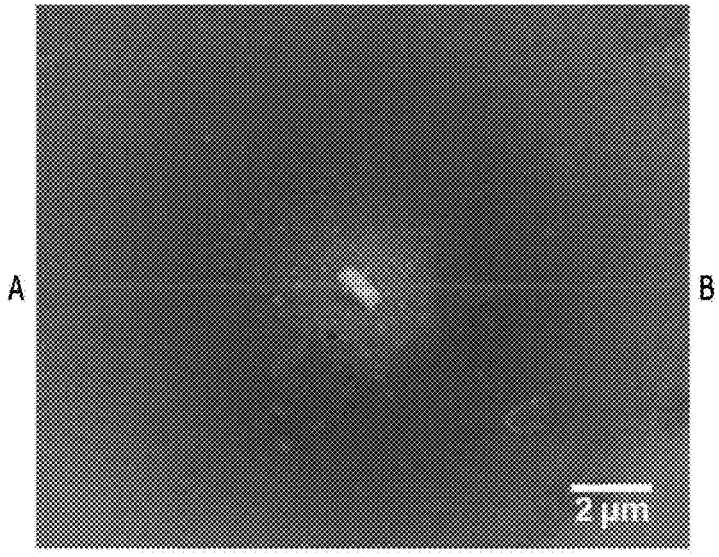
FIG. 3 is a scanning electron microscope (SEM) photograph showing a microstructure of the Mg-3Al-0.1Sc alloy according to Example 5 of the present invention.
Figure 4:
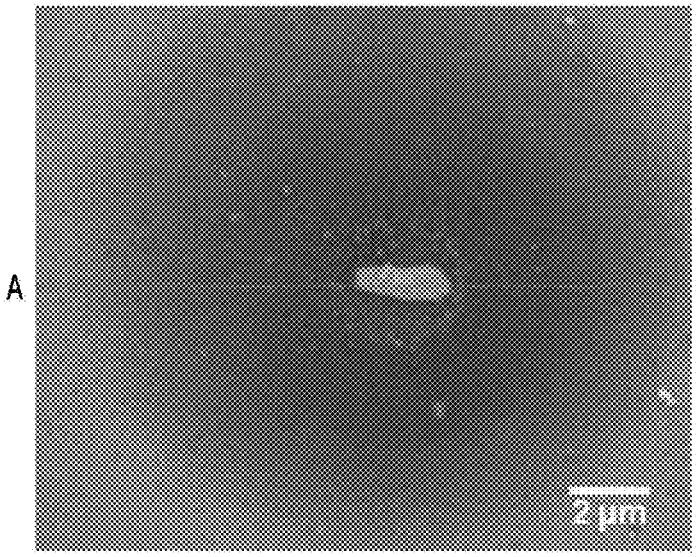
FIG. 4 is a scanning electron microscope (SEM) photograph showing a microstructure of the Mg-3Al-0.3Sc alloy according to Example 6 of the present invention.

FIG. 3 shows a microstructure of Example 5 (Mg-3Al-0.1Sc alloy), in which a secondary phase compound separated from magnesium is present in the alloy like the Mg-3Al alloy of Comparative Example 1. Specifically, FIG. 3 confirms the presence of the secondary phase compound, and the secondary phase compound has an average particle diameter of about 1 μm.

FIG. 3 shows a microstructure of Example 6 (Mg-3Al-0.3Sc alloy), in which a secondary phase compound separated from magnesium is present in the alloy like the Mg-3Al alloy of Comparative Example 1. Specifically, FIG. 4 confirms the presence of the secondary phase compound, and the secondary phase compound has an average particle diameter of about 2 μm.

Experimental Example 3

Component Analysis of Secondary Phase Compound in Alloy

Component analyses of the secondary phase compounds of the alloys according to Comparative Example 1 and Examples 5 and 6 were performed by using an EDS (Energy Dispersive Spectroscopy) equipment of EDAX. The results are shown in FIGS. 5 to 7.

Figure 5:
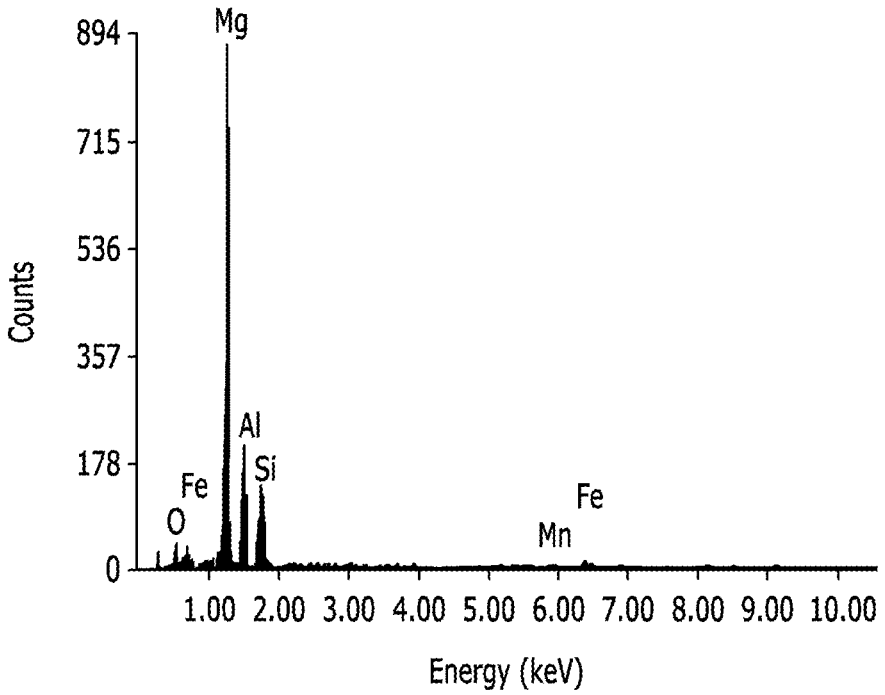
FIG. 5 shows component analysis results of the secondary phase compound of the Mg-3Al alloy according to Comparative Example 1 of the present invention.

FIG. 5 shows component analysis results of the secondary phase compound in the alloy of Comparative Example 1 (Mg-3Al alloy) and the results show that the secondary phase compound includes Al and impurity elements such as Si and Fe.

Figure 6:
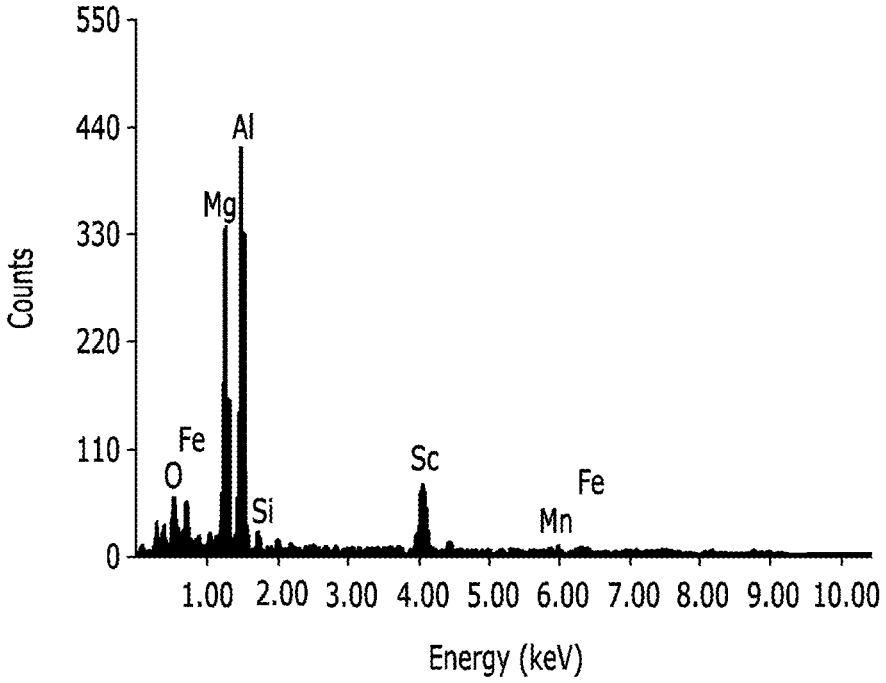
FIG. 6 shows component analysis results of the secondary phase compound of the Mg-3Al-0.1Sc alloy according to Example 5 of the present invention.

FIG. 6 shows component analysis results of the secondary phase compound in the alloy of Example 5 (Mg-3Al-0.1Sc alloy) and the results show that the secondary phase compound mainly includes Al and Sc and impurity elements such as Si and Fe.

Figure 7:
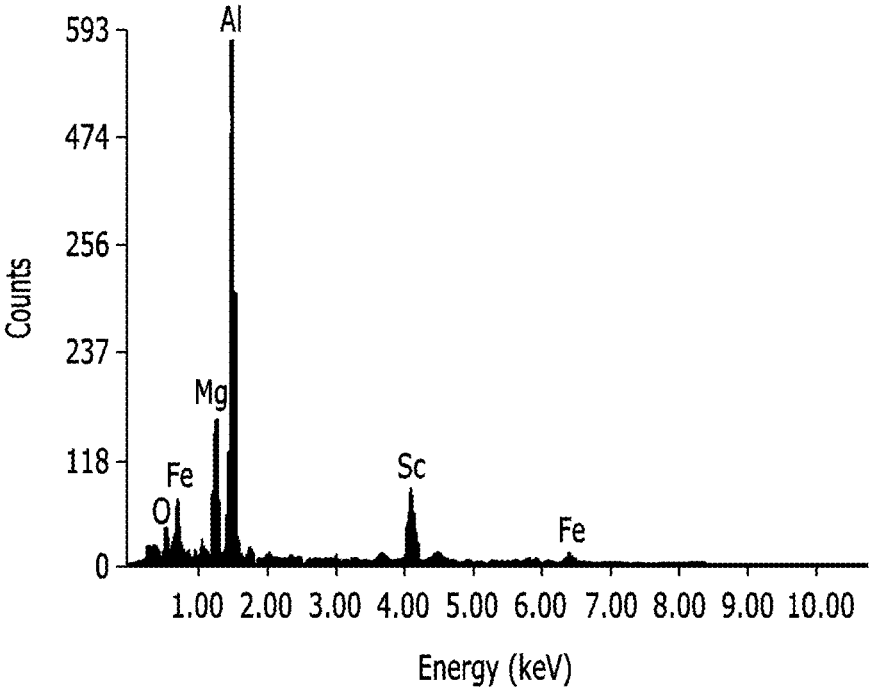
FIG. 7 shows component analysis results of the secondary phase compound of the Mg-3Al-0.3Sc alloy according to Example 6 of the present invention.

FIG. 7 shows component analysis results of the secondary phase compound in the alloy of Example 6 (Mg-3Al-0.3Sc alloy) and the results show that the secondary phase compound mainly includes Al and Sc and impurity elements such as Fe.

Experimental Example 4

Measurement of Volta Potential

An XE-70 AFM (Atomic Force Microscopy) equipment made by Park Systems Inc. was used to measure a Volta potential difference between a secondary phase compound and a magnesium base in the alloys according to Comparative Example 1 and Examples 5 and 6. The results are shown in FIGS. 8 to 10.

Figure 8:
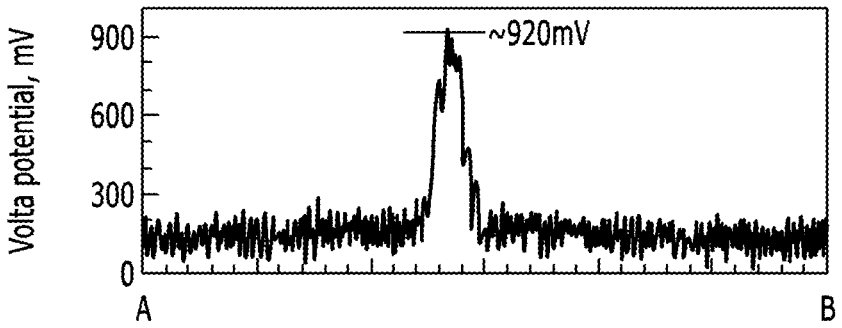
FIG. 8 is a graph showing a Volta potential of the Mg-3Al alloy along with the line of FIG. 2.

FIG. 8 is a graph showing a Volta potential measured along with the line in FIG. 2 that is a scanning electron microscope (SEM) photograph of Comparative Example 1 (Mg-3Al alloy), which indicates that a Volta potential difference between the secondary phase compound and the magnesium base is about 920 mV.

Figure 9:
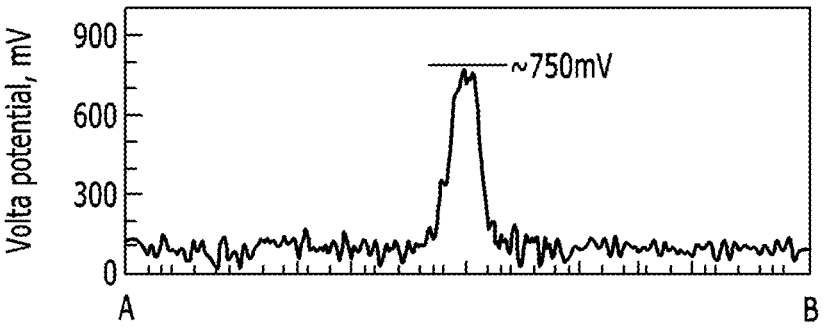
FIG. 9 is a graph showing a Volta potential of the Mg-3Al-0.1Sc alloy along with the line of FIG. 3.

FIG. 9 is a graph showing a Volta potential measured along with the line in FIG. 3 that is a scanning electron microscope (SEM) photograph of Example 5 (Mg-3Al-0.1Sc alloy), which indicates that a Volta potential difference between the secondary phase compound and the magnesium base of the Mg-3Al-0.1Sc alloy is about 750 mV.

Figure 10:
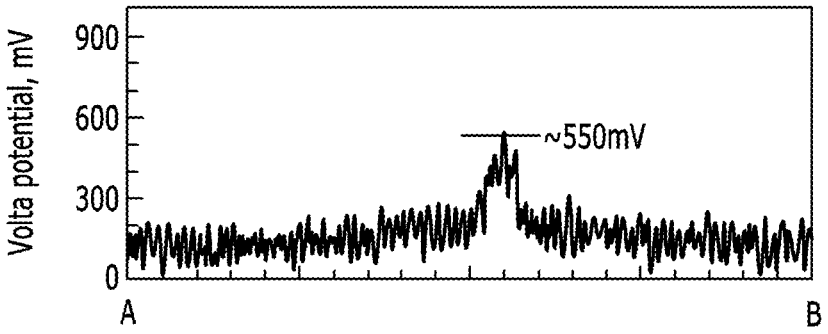
FIG. 10 is a graph showinga Volta potential measured along with the line in FIG. 4.

FIG. 10 is a graph showing a Volta potential measured along with the line in FIG. 4 that is a scanning electron microscope (SEM) photograph of Example 6 (Mg-3Al-0.35c alloy), which indicates that a Volta potential difference between the secondary phase compound and the magnesium base of the Mg-3Al-0.35c alloy is about 550 mV.

The results of the example embodiments were much lower than a Volta potential measured in Comparative Example 1 (Mg-3Al alloy). Accordingly, microgalvanic corrosion in an alloy under a corrosion environment was effectively suppressed by addition of Sc, and anti-corrosion of a magnesium alloy may be improved. The Volta potential difference decrease effect was equally found in the other Comparative Examples and Examples referring to a corrosion rate decrease effect of Table 2.

Experimental Example 5

Measurement of Ignition Temperature

Each magnesium melt including components and a composition shown in Tables 3 to 5 and including Mg and inevitable impurities as a balance was cast to manufacture a cast material.

As a result, a corrosion rate and an ignition temperature were measured depending on an alloy component and a composition of Examples and Comparative Examples, and the results are shown in Tables 3 to 5.

Herein, the corrosion rate was evaluated in the same method as used in Experimental Example 1, and the ignition temperature was evaluated as follows.

After maintaining a tube furnace used to measure the ignition temperature at 1000° C. and mounting the alloy specimen in a specimen holder equipped with a temperature sensor, the specimen was transported into the furnace by using a sliding frame. Then, a temperature change of the specimen depending on time was measured. As a result, the temperature change result of the specimen is shown in FIG. 3, and herein, a temperature sharply increased depending on time was regarded as the ignition temperature of an alloy.

Figure 13:
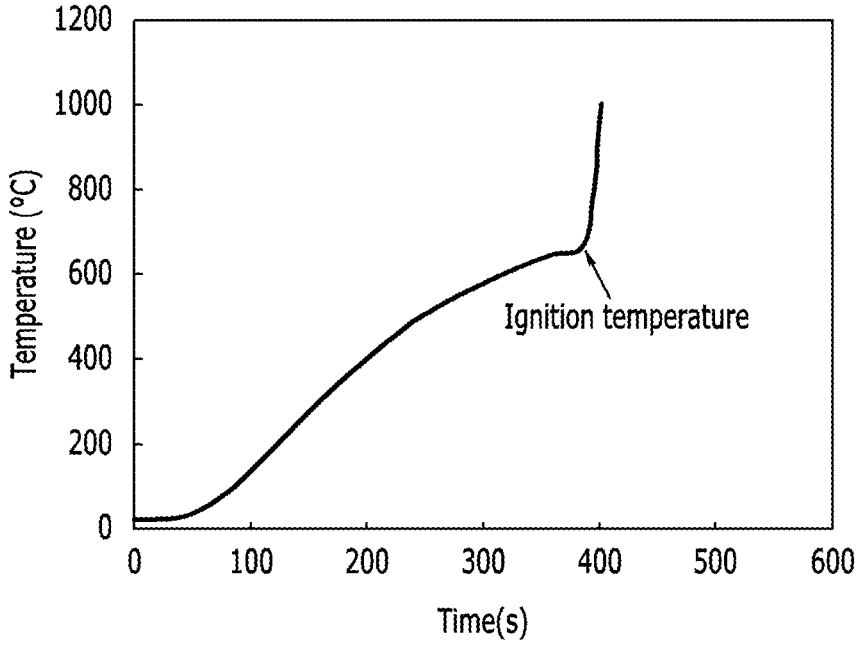
FIG. 13 is a graph showing anti-ignition temperature point at measurement of an ignition temperature.

FIG. 13 is a graph showing an anti-ignition temperature point at measurement of an ignition temperature.

TABLE 3

| | Al (wt %) | Ca (wt %) | Y (wt %) | Sc (wt %) | Mn (wt %) | Zn (wt %) | Corrosion rate (mmpy) | Ignition temperature (° C.) |
|---|---|---|---|---|---|---|---|---|
| Comparative Example1a | 3 | 0.05 | 0.1 | — | — | — | 1.90 | 670 |
| Example1a | 3 | 0.05 | 0.1 | 0.15 | — | — | 0.53 | 716 |
| Comparative Example2a | 3 | 0.05 | 0.5 | — | — | — | 2.19 | 763 |
| Comparative Example3a | 3 | 0.1 | 0.1 | — | — | — | 4.02 | 682 |
| Example2a | 3 | 0.1 | 0.1 | 0.1 | — | — | 0.47 | 708 |
| Comparative Example4a | 3 | 0.5 | 0.1 | — | — | — | 2.47 | 799 |

TABLE 3-continued

| | Al (wt %) | Ca (wt %) | Y (wt %) | Sc (wt %) | Mn (wt %) | Zn (wt %) | Corrosion rate (mmpy) | Ignition temperature (° C.) |
|---|---|---|---|---|---|---|---|---|
| Comparative Example5a | 3 | 0.5 | 0.1 | 0.01 | — | — | 2.43 | 813 |
| Example3a | 3 | 0.5 | 0.1 | 0.02 | — | — | 0.65 | 823 |
| Example4a | 3 | 0.5 | 0.1 | 0.03 | — | — | 0.44 | 830 |
| Example5a | 3 | 0.5 | 0.1 | 0.1 | — | — | 0.36 | 850 |
| Example6a | 3 | 0.5 | 0.1 | 0.3 | — | — | 0.50 | 875 |
| Example7a | 3 | 0.5 | 0.1 | 0.6 | — | — | 0.60 | 930 |
| Comparative Example6a | 3 | 2.1 | 0.1 | 0.1 | — | — | 0.43 | 835 |
| Comparative Example7a | 3 | 0.5 | 0.6 | 0.1 | — | — | 2.08 | 802 |
| Comparative Example8a | 3 | 0.5 | 0.005 | — | — | — | 9.56 | 775 |
| Example8a | 3 | 0.5 | 0.005 | 0.1 | — | — | 0.46 | 850 |
| Comparative Example9a | 3 | 0.5 | 0.5 | — | — | — | 3.27 | 914 |
| Example9a | 3 | 0.5 | 0.5 | 0.1 | — | — | 0.40 | 979 |
| Comparative Example10a | 3 | — | — | 0.1 | — | — | 0.45 | 663 |

TABLE 4

| | Al (wt %) | Ca (wt %) | Y (wt %) | Sc (wt %) | Mn (wt %) | Zn (wt %) | Corrosion rate (mmpy) | Ignition temperature (° C.) |
|---|---|---|---|---|---|---|---|---|
| Example 10a | 3 | 0.5 | 0.1 | 0.1 | — | — | 0.36 | 850 |
| Example 11a | 3 | 0.5 | 0.1 | 0.1 | 0.1 | — | 0.32 | 774 |
| Example 12a | 3 | 0.5 | 0.1 | 0.1 | 0.3 | — | 0.19 | 752 |
| Example 13a | 3 | 0.5 | 0.1 | 0.1 | 0.5 | — | 0.32 | 750 |
| Comparative Example 11a | 3 | 0.5 | 0.1 | 0.1 | 0.75 | — | 2.27 | 750 |
| Comparative Example 12a | 3 | 0.5 | 0.1 | 0.1 | 1.0 | — | 6.21 | 767 |
| Example 14a | 3 | 0.5 | 0.1 | 0.1 | — | 0.1 | 0.38 | 840 |
| Example 15a | 3 | 0.5 | 0.1 | 0.1 | — | 1.0 | 0.60 | 825 |
| Example 16a | 3 | 0.5 | 0.1 | 0.1 | — | 4.5 | 0.95 | 801 |
| Comparative Example 13a | 3 | 0.5 | 0.1 | 0.1 | — | 5.0 | 1.39 | 788 |

As shown in Tables 3 and 4, Examples including Ca, Y, and Sc components as a necessary component in a magnesium alloy material and satisfying a composition range of the present invention showed a corrosion rate of less than or equal to 1 mmpy and satisfied an ignition temperature condition of greater than or equal to 700° C.

On the other hand, Comparative Examples not including at least one of Ca, Y, and Sc or including all the Ca, Y, and Sc components but not satisfying the composition range of the present invention showed a faster corrosion rate or a lower ignition temperature than that of Examples.

In addition, a sum of weights of the Ca, Y, and Sc components in Examples 1a to 7a of the present invention was 0.3, 0.3, 0.62, 0.63, 0.7, 0.9, and 1.2 wt %. Accordingly, the ignition temperatures of Examples 1a to 7a gradually increased.

On the other hand, Comparative Examples 1a, 3a, and 10a having less than 0.3 wt % of a sum of Ca, Y, and Sc components showed a low ignition temperature of less than 700° C.

Figure 11:
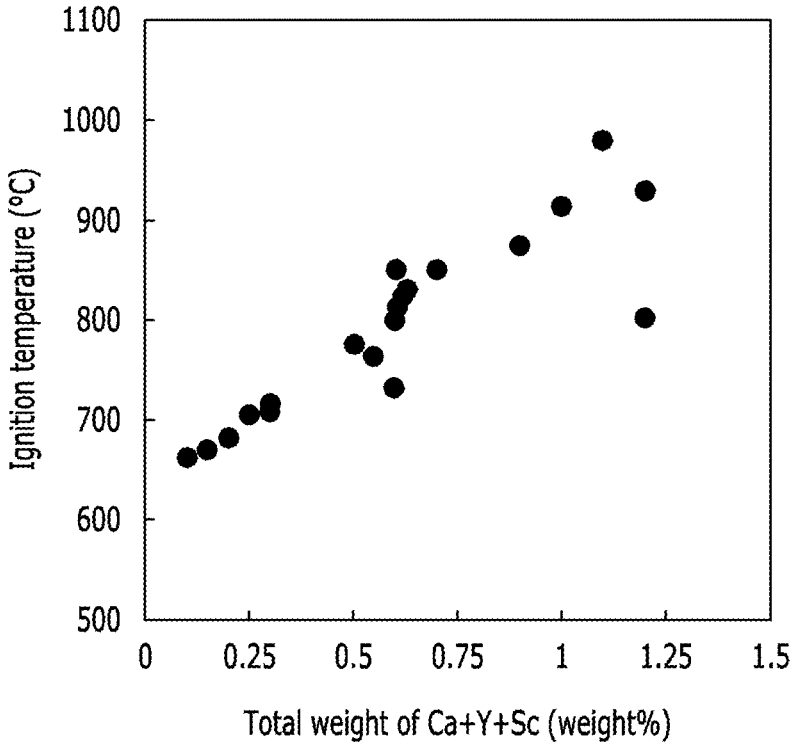
FIG. 11 is a graph showing a relationship between a sum of weights of Ca, Y, and Sc components in the Mg-3Al magnesium alloy and an ignition temperature.

This is confirmed through FIG. 11 of the present invention.

FIG. 11 of the present application is a graph showing a relationship between a sum of weights of Ca, Y, and Sc components in the Mg-3Al magnesium alloy and an ignition temperature.

In this way, a magnesium alloy material having excellent anti-ignition may be provided by including Ca, Y and Sc component as a necessary component and controlling a sum of weights of the components into greater than or equal to 0.3 wt %.

In addition, Comparative Example 6a included 2.1 wt % of Ca and showed relatively excellent corrosion rate and ignition temperature. However, Comparative Example 6a included calcium excessively and showed a crack phenomenon during a compression process.

Figure 12:
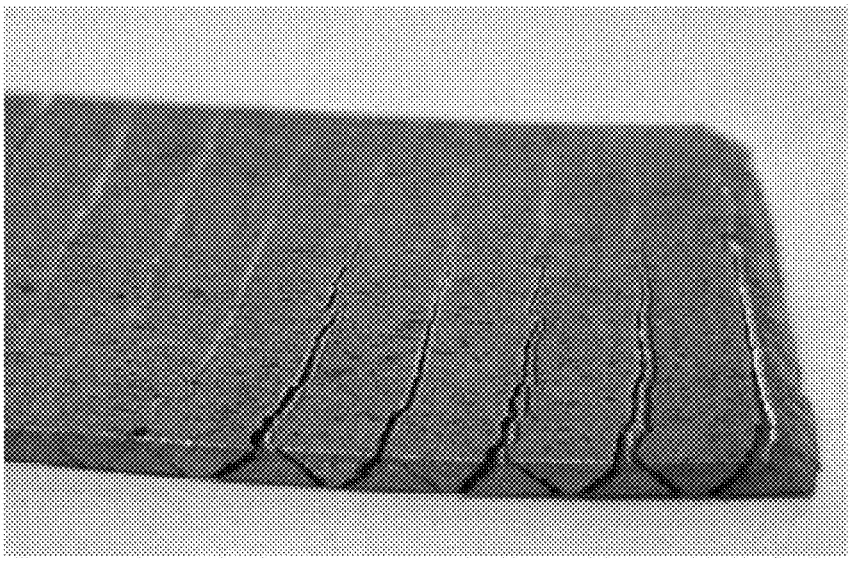

This is confirmed through FIG. 12.

FIG. 12 shows compression cracks of Comparative Example 6a.

As shown in FIG. 12, Comparative Example 6a included calcium excessively and showed a compression crack phenomenon. Accordingly, calcium may be included in an amount of 2.0 wt %.

In addition, as shown in Table 4, Examples of the present invention may further include Mn or Zn. When Mn is further included, corrosion resistance may be more excellent. Specifically, Examples 11a to 13a further including manganese in addition to a composition of Example 10a showed a decreased corrosion rate compared with that of Example 10a.

Zn may contribute to increasing strength of an alloy. However, when Zn is excessively added, corrosion resistance may be sharply deteriorated as shown in Comparative Example 13a.

TABLE 5

| | Al (wt %) | Ca (wt %) | Y (wt %) | Sc (wt %) | Mn (wt %) | Zn (wt %) | Corrosion rate (mmpy) | Ignition temperature (° C.) |
|---|---|---|---|---|---|---|---|---|
| Comparative Example 14a | 0.5 | 0.5 | 0.1 | — | — | — | 3.67 | 724 |
| Example 17a | 0.5 | 0.5 | 0.1 | 0.1 | — | — | 0.82 | 702 |
| Example 18a | 6 | 0.5 | 0.2 | 0.1 | 0.3 | — | 0.28 | 782 |
| Example 19a | 6 | 0.25 | 0.25 | 0.1 | 0.3 | — | 0.28 | 746 |
| Example 20a | 9 | 0.25 | 0.25 | 0.1 | 0.3 | — | 0.27 | 774 |
| Example 21a | 9 | 0.5 | 0.2 | 0.1 | 0.3 | — | 0.54 | 785 |

As shown in Table 5 of the present invention, a magnesium alloy material having excellent corrosion resistance and anti-ignition may be provided by adding Ca, Y, and Sc except for a Mg-3Al-based alloy.

In addition, the corrosion resistance may be further improved by adding manganese.

The present invention is not limited to the example embodiments and may be embodied in various modifications, and it will be understood by a person of ordinary skill in the art to which the present invention pertains that the present invention may be carried out through other specific embodiments without modifying the technical idea or essential characteristics thereof. Therefore, the aforementioned embodiments should be understood to be exemplary but not limiting the present invention in any way.

The invention claimed is:

1. A magnesium alloy material consisting of with respect to the total of 100 wt% of the magnesium alloy material, Sc of 0.01 to 0.3 wt%; Al of 0.05 to 15.0 wt%; and the balance being Mg and other unavoidable impurities, wherein the magnesium alloy material comprises a secondary phase compound comprising Al and Sc in the alloy in which a Volta potential difference between the secondary phase compound and a magnesium base is less than 920 mV.

2. The magnesium alloy material of claim 1, wherein an amount of Al of the magnesium alloy material is 0.05 to 9.0 wt% with respect to the total of 100 wt% of the magnesium alloy material.

3. The magnesium alloy material of claim 1, wherein the secondary phase compound has an average particle diameter of 0.1 to 10 μm.

4. The magnesium alloy material of claim 3, wherein the Volta potential difference between the secondary phase compound and a magnesium base is less than or equal to 750 mV.

5. The magnesium alloy material of claim 4, wherein the magnesium alloy material exhibits a corrosion rate of less than or equal to 1.22 mmpy in a room temperature immersion test in a 3.5 wt% of NaCl solution for 72 hours.

6. A magnesium alloy material comprising with respect to the total of 100 wt% of the magnesium alloy material, Sc of 0.01 to 0.3 wt%; Al of 6 to 15.0 wt%; at least one metal selected from Zn of 0.005 to 10.0 wt%, Mn of 0.005 to 2.0 wt%, or Ca of 0.005 to 2.0 wt%; and the balance being Mg and other unavoidable impurities, wherein the magnesium alloy material comprises a secondary phase compound comprising Al and Sc in the alloy in which a Volta potential difference between the secondary phase compound and a magnesium base is less than 920 mV.

7. The magnesium alloy material of claim 6, wherein the magnesium alloy material further comprises at least one metal selected from Zn of 0.5 to 5.0 wt%, Mn of 0.05 to 1.0 wt%, or Ca of 0.25 to 1.0 wt% with respect to the total of 100 wt% of the magnesium alloy material.

8. A magnesium alloy material comprising, with respect to the total of 100 wt% thereof: Al of 0.5 to 12.0 wt%, Ca of 0.25 to 2.0 wt%, Y of 0.005 to 0.5 wt%, Sc of 0.02 to 0.6 wt%, Mn of 0.3 to 0.5 wt%, the balance being Mg and other unavoidable impurities, wherein a sum of the weights of the Ca, Y, and Sc components is greater than or equal to 0.3 wt%.

9. The magnesium alloy material of claim 8, wherein the magnesium alloy material further comprises Zn of less than 5 wt% with respect to the total of 100 wt% of the magnesium alloy material.

10. The magnesium alloy material of claim 8, wherein the magnesium alloy material exhibits a corrosion rate of less than or equal to 1.0 mmpy in a room temperature immersion test in a 3.5 wt% of NaCl solution for 72 hours.

11. The magnesium alloy material of claim 10, wherein the magnesium alloy material has an ignition temperature of greater than or equal to 700° C.

* * * * *